US009365030B2

(12) United States Patent
Heiler et al.

(10) Patent No.: US 9,365,030 B2
(45) Date of Patent: Jun. 14, 2016

(54) METHOD FOR REGISTER ADJUSTMENT DURING SET-UP PROCESSES IN PRINTING PRESSES AND PRINTING PRESS CARRYING OUT THE METHOD

(71) Applicant: HEIDELBERGER DRUCKMASCHINEN AG, Heidelberg (DE)

(72) Inventors: Peter Heiler, Forst (DE); Rolf Kuendgen, Bad Schoenborn (DE); Gerd Merkel, Dielheim (DE); Rudi Stellberger, Kronau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/022,446

(22) Filed: Sep. 10, 2013

(65) Prior Publication Data

US 2014/0069288 A1 Mar. 13, 2014

(30) Foreign Application Priority Data

Sep. 10, 2012 (DE) ..... 10 2012 017 839

(51) Int. Cl.
*B41F 27/00* (2006.01)
*B41F 33/00* (2006.01)
*B41F 27/12* (2006.01)

(52) U.S. Cl.
CPC ..... *B41F 27/005* (2013.01); *B41F 27/1206* (2013.01); *B41P 2233/13* (2013.01)

(58) Field of Classification Search
CPC ..... B41F 27/005; B41F 27/1206; B41F 33/0081; B41P 2233/13
See application file for complete search history.

(56) References Cited

U.S. PATENT DOCUMENTS

| | | | | | |
|---|---|---|---|---|---|
| 3,701,464 | A * | 10/1972 | Crum | 226/3 |
| 4,391,190 | A * | 7/1983 | Metzler | 101/211 |
| 5,390,603 | A * | 2/1995 | Hauck et al. | 101/485 |
| 6,499,397 | B2 * | 12/2002 | Stern | 101/248 |

(Continued)

FOREIGN PATENT DOCUMENTS

| | | | |
|---|---|---|---|
| DE | 102005018475 | A1 | 8/2006 |
| DE | 102007043851 | A1 | 4/2008 |
| DE | 102009028208 | A1 | 2/2011 |

(Continued)

OTHER PUBLICATIONS

Kipphan, Helmut, Handbook of Print Media, 2001, Springer-Verlag, pp. 240-241, 307-308.*

(Continued)

*Primary Examiner* — Matthew G Marini
*Assistant Examiner* — Leo T Hinze
(74) *Attorney, Agent, or Firm* — Laurence A. Greenberg; Werner H. Stemer; Ralph E. Locher

(57) ABSTRACT

A method for setting up printing presses includes providing cylinders, a drive for at least one cylinder, a register adjustment device for at least one cylinder and at least one control unit. During set-up operations on the printing press, the control unit actuates the register adjustment device while the printing press is being accelerated or decelerated or while washing operations in the printing press are being carried out and while a production run is switched off and cylinders are rotating. A printing press carrying out the method is also provided.

10 Claims, 4 Drawing Sheets

(56) References Cited

U.S. PATENT DOCUMENTS

| | | | | |
|---|---|---|---|---|
| 6,675,707 | B1 | 1/2004 | Heiler et al. | |
| 7,552,678 | B2 * | 6/2009 | Doeres et al. | 101/248 |
| 8,001,900 | B2 * | 8/2011 | Kimura et al. | 101/486 |
| 2010/0313780 | A1 * | 12/2010 | Sato | B41F 13/12 101/481 |
| 2011/0226146 | A1 * | 9/2011 | Greive et al. | 101/479 |

FOREIGN PATENT DOCUMENTS

| | | | |
|---|---|---|---|
| DE | 102012205527 | A1 | 10/2012 |
| EP | 2067621 | A1 | 6/2009 |

OTHER PUBLICATIONS

German Patent and Trademark Office Search Report Dated Mar. 19, 2013.

* cited by examiner

METHOD FOR REGISTER ADJUSTMENT DURING SET-UP PROCESSES IN PRINTING PRESSES AND PRINTING PRESS CARRYING OUT THE METHOD

CROSS-REFERENCE TO RELATED APPLICATION

This application claims the priority, under 35 U.S.C. §119, of German Patent Application DE 10 2012 017 839.5, filed Sep. 10, 2012; the prior application is herewith incorporated by reference in its entirety.

BACKGROUND OF THE INVENTION

Field of the Invention

The present invention relates to a method for setting up printing presses having cylinders, a drive for at least one cylinder, a register adjustment device for at least one cylinder and at least one control unit. The invention also relates to a printing press carrying out the method.

Such methods are known, for example, from German Patent Application DE 10 2007 043 851 A1. That document describes a method for pre-setting the register in a printing press for multi-color printing. The method is used to appropriately pre-set the register in the case of a plate change. When the plate change is completed, the distances of a clamping device for receiving the plate cylinders are measured and, based on the distances, a control unit determines corresponding settings for the register pre-setting devices. In that way, the plate cylinders are adjusted to compensate for the measured distances. Thus, by determining the distances, the control unit may predefine corresponding control signals for the register adjustment device to automatically compensate for the distances. A disadvantage of that method is that all adjustment processes are carried out sequentially, causing the compensatory adjustment to take up additional set-up time.

U.S. Pat. No. 6,675,707 B1 discloses a positioning device for positioning an adjustable cylinder in a printing unit in a printing press. The positioning process is distinguished by multiple steps at least some of which are carried out simultaneously. Initially, a cylinder guiding printing substrates is moved into a defined angular position. Subsequently, the adjustable cylinder is likewise moved into a defined angular position. Then the positioning device moves the circumferential register adjustments of the adjustable cylinder and the adjustable cylinder itself from a first cylinder position into a second cylinder position along an adjustment path. At least two of those steps may be carried out simultaneously to save time. However, those two steps exclusively focus on positioning aspects and do not deal with starting up or shutting down a printing press upon a plate change. That means that for a plate change, for example, the positioning processes for starting up or shutting down a printing press are carried out sequentially, which requires a corresponding amount of time.

BRIEF SUMMARY OF THE INVENTION

It is accordingly an object of the invention to provide a method for register adjustment during set-up processes in printing presses and a printing press carrying out the method, which overcome the hereinafore-mentioned disadvantages of the heretofore-known methods and printing presses of this general type and which further minimize set-up times, in particular for a plate change in a printing press.

With the foregoing and other objects in view there is provided, in accordance with the invention, a method for setting up printing presses having cylinders, a drive for at least one of the cylinders, a register adjustment device for at least one of the cylinders and at least one control unit. The method comprises actuating the register adjustment device using the control unit during a set-up operation while the printing press is being decelerated or accelerated or while washing operations are being carried out in the printing press and while a production run is switched off and the cylinders are rotating.

In accordance with the invention, for the first time it is possible to have register adjustment processes, for example in the case of a plate change, run in parallel with rotary movements of the cylinders, for example in the case of a start-up or shut-down of the printing press, resulting in a further minimization of set-up times due to the parallel processes. The method of the invention may be applied to all rotary printing presses that have register adjustment devices connected to a control unit. The control unit controls both the register adjustment and the drive motor of the printing press that drives the rotation of the cylinders.

In accordance with a first embodiment of the invention, the drive and the register adjustment device are associated with the same cylinder in the same printing unit of the printing press. This cylinder may in particular be the plate cylinder or the blanket cylinder. In this case, the rotating cylinders are driven through the cylinder on which the register adjustment is made. In accordance with an alternative embodiment, a provision is made for the drive to be associated with a first cylinder in the printing press and for the register adjustment device to be associated with a second cylinder in the printing press. In this case, the rotating cylinders are not driven through the plate cylinder or blanket cylinder having a position which is changed by the register adjustment device. Instead, the rotating cylinders are driven through other cylinders, for example transport cylinders in the sheet path of the printing press. It is to be understood that it is possible to carry out adjustments on multiple cylinders in one printing unit or in different printing units at the same time using multiple register adjustment devices and at the same time to rotate the cylinders by using the drive motor of the printing press.

In accordance with a further advantageous feature, a provision is made for the register adjustment device to be actuated by the control unit while the printing press is decelerated, the printing operation is stopped, and the cylinders rotate. In order to set-up the printing press for a plate change, it needs to be decelerated from the production speed to a standstill. The braking process may be used simultaneously to carry out the required register adjustment processes because with the printing operating stopped, no printing substrates are being produced and thus the register adjustment processes have no effect on the quality of any printing substrate that is produced.

In accordance with a further embodiment of the invention, after a plate change on a plate cylinder, the control unit accelerates the printing press and simultaneously actuates the register adjustment device. In this case, the plate change is already completed and the printing press needs to be accelerated from standstill to production speed. While the printing process continues to be switched off and no printing substrates are being transported through the printing press, the plate cylinder is accelerated and register adjustment processes are carried out at the same time to ensure that the color separations are accurately printed on top of each other during the subsequent production run. In this case, too, the rotating cylinders and the register adjustment are controlled by the control unit without any need for operator intervention.

In accordance with an advantageous further feature, the register adjustment is actuated by the control unit while a rotating blanket cylinder is being washed. When the printing ink needs to be changed during a set-up process with or without a plate change, the ink-guiding cylinders, including the rotating blanket cylinder, need to be washed. This washing process also takes time, which in accordance with the invention may now be used to make simultaneous register adjustments on one or more printing units. Since the register adjustments are made during the process of washing one or more rotating blanket cylinders, the register adjustments are not carried out sequentially and do not take up any time in addition to the washing time.

In accordance with a particularly advantageous embodiment of the invention, the control unit simultaneously adjusts the circumferential, lateral and diagonal registers on one and the same cylinder. In this way, the circumferential, lateral and diagonal register adjustments are carried out in parallel with the further set-up operations such as accelerating or decelerating the printing press or washing the blanket cylinder, resulting in correct adjustments of the circumferential, lateral, and diagonal registers during set-up.

In accordance with a further embodiment of the invention, the control unit actuates the register adjustment device at the same time as it switches from production speed to idle speed and vice versa. In this case, register adjustments do not take place during an acceleration or deceleration of the printing press from standstill to idle speed but during the acceleration and deceleration, respectively, from idle speed to production speed. Using the acceleration and deceleration processes for simultaneous register adjustments in this way also saves time during the set-up process.

In accordance with an advantageous further feature, the register adjustment device is actuated and moved to the zero position by the control unit while the printing press is decelerated from the production speed to carry out a plate change. When a plate change is carried out, many register adjustment devices require an initial return to the zero position in order to ensure accurate calibration. Only a return to the zero position ensures that starting from the zero position, the correct register control values are reached during the actual register adjustment process. In accordance with the invention, this return to the zero position may now be carried out while the printing press is decelerated from production speed to idle speed or from idle speed to standstill prior to a plate change. In this case, the register adjustments are divided into two phases. Prior to the plate change, the register adjustment devices are returned to the zero position. After the plate change, during re-acceleration of the printing press, the correct register control values are set for the following print job. In this way, both the return to the zero position and the setting of the register control values for the subsequent production run do not require any time in addition to the other processes of accelerating or decelerating the printing press for a plate change.

With the objects of the invention in view, there is concomitantly provided a printing press, comprising a control unit configured or programmed to carry out the method according to the invention.

The present invention, in particular, allows the time required for a plate change to be further reduced because the register adjustments do not require time in addition to the other set-up processes. This saves approximately 10% to 20% of the entire set-up time for a plate change. Thus, the time required for a plate change is further reduced without the provision of complex technical measures such as a directly driven plate cylinder having a separate drive.

Other features which are considered as characteristic for the invention are set forth in the appended claims.

Although the invention is illustrated and described herein as embodied in a method for register adjustment during set-up processes in printing presses and a printing press carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
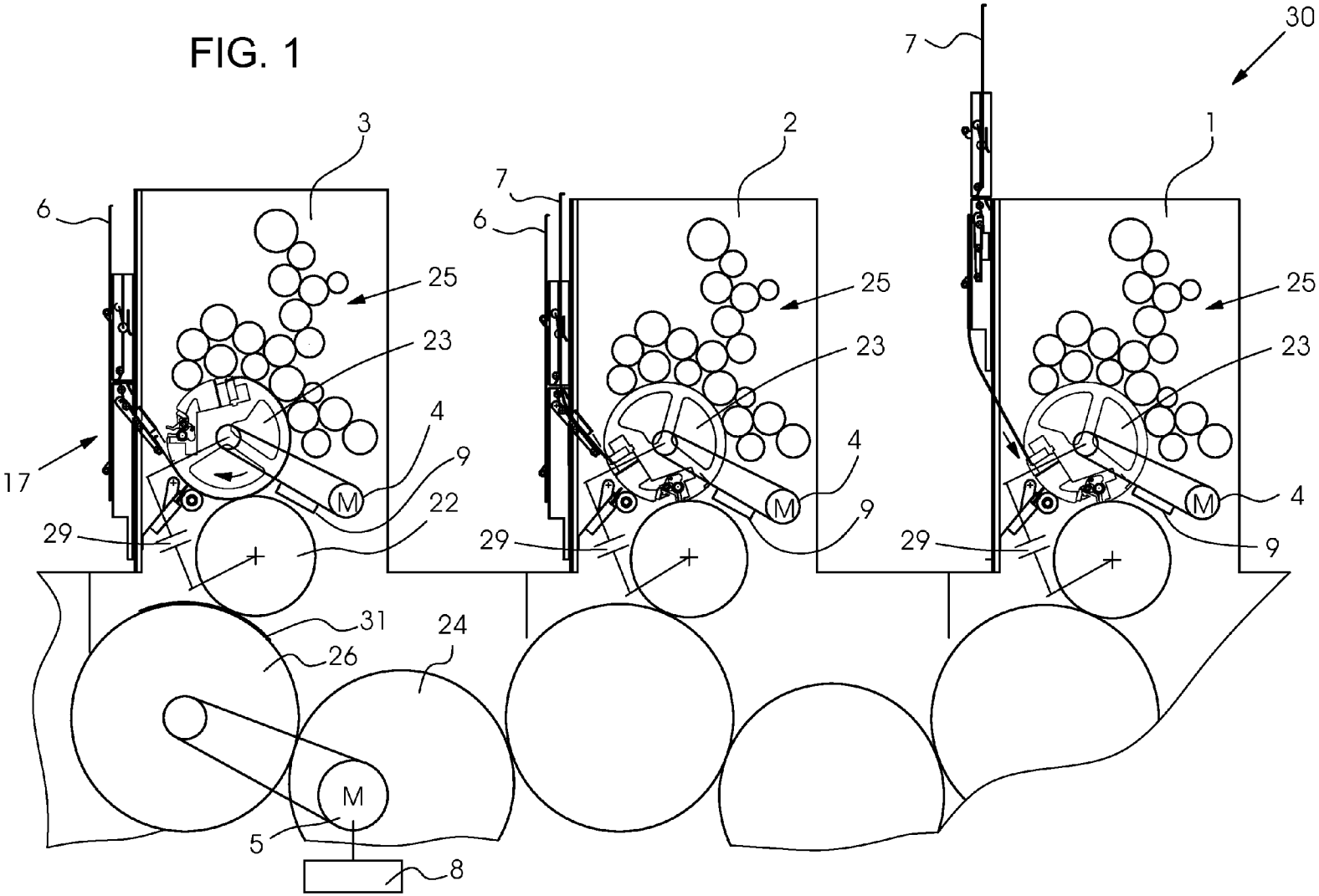
FIG. 1 is a fragmentary, diagrammatic, longitudinal-sectional view of a sheet-fed rotary lithographic offset printing press having multiple printing units, a plate changing device, a register adjustment device, a drive motor for rotating cylinders and a control unit.

Referring now to the figures of the drawings in detail and first, particularly, to FIG. 1 thereof, there is seen a sheet-fed rotary lithographic offset printing press 30 including three printing units 1, 2, 3. The illustration is given by way of example only and is not to be understood as limiting the invention to being used in sheet-fed rotary printing presses. The present invention may be used in all printing presses that require the changing of printing plates or similar covers. In principle, the three printing units 1, 2, 3 shown in FIG. 1 are of identical construction. Each printing unit 1, 2, 3 is equipped with a blanket cylinder 22, a plate cylinder 23 and an impression cylinder 26. Sheet-shaped printing substrates 31 are transported between the printing units 1, 2, 3 by transport cylinders 24. In the printing press 30 shown in FIG. 1, the blanket cylinders 22, plate cylinder 23, transport cylinder 24 and impression cylinders 26 are mechanically coupled by a non-illustrated gear train and can thus be driven in synchronism at an identical speed by a drive motor 5 during a printing operation. The plate cylinders 23 may additionally be uncoupled from the associated blanket cylinder 22 by using a clutch 29. This means that during a plate change, the plate cylinders 23 may independently and separately be driven in each printing unit 1, 2, 3 by a drive motor 4. Moreover, each of the printing units 1, 2, 3 includes an inking unit 25, which applies ink to printing plates 6, 7 on the plate cylinders 23.

The printing press 30 is controlled by a control unit or controller 8, which actuates all of the drive motors 4, 5 and register adjustment drives 9 on the plate cylinders 23. In this way, the control unit 8 may carry out a fully automated plate change by using a plate changer 17 associated with the respective printing unit 1, 2, 3. The three printing units 1, 2, 3 are all shown in different stages during a plate change. The printing unit 3 is in the initial stage of a plate change wherein an old printing plate 7 is ejected into the plate changer 17 as illustrated by an arrow showing rotation of the plate cylinder 23. While this is being done, a new printing plate 6 is stored in the plate changer 17. On the printing unit 2, the old printing plate 7 can be seen to have left the plate cylinder 23 completely and to be stored in the plate changer 17. The printing unit 1 is in the final stage of the plate change in which the old printing plate 7 is completely removed from the printing unit 1 due to an upward movement of the plate changer 17 and the new printing plate 6 is inserted into the printing unit 1 from above in the direction of an arrow and then fixed to the plate cylinder 23.

Figure 2:
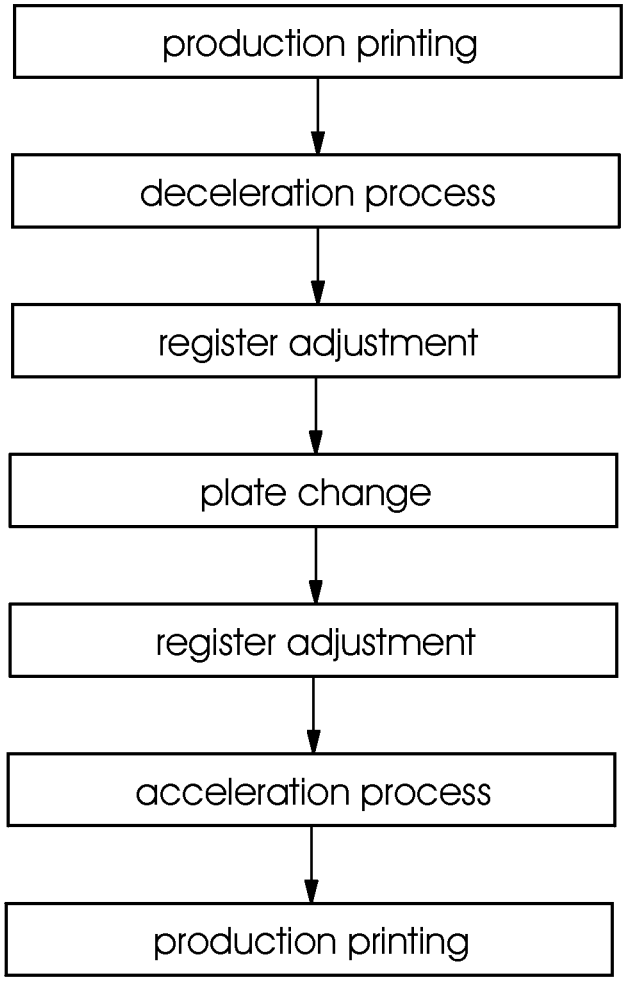
FIG. 2 PRIOR ART
FIG. 2 is a flow diagram illustrating a sequence of set-up processes for a prior art plate change.

FIG. 2 illustrates an example of a prior art plate changing sequence. At first, the printing press 30 is decelerated from production speed to a standstill. In the process, the printing speed is reduced and the transport of printing substrates is stopped. Once the printing press 30 has been decelerated, the register adjustment drives 9 move the plate cylinders 23 into a zero position before the actual change of the printing plates 6, 7 is carried out. When the plate change is completed, the printing press 30 is re-accelerated, and subsequently the register adjustment drives 9 move the plate cylinders 23 into the correct positions for the new print job. Subsequently, the transport of printing substrates is switched on and the printing press 30 is accelerated to production speed. These steps are carried out sequentially and require a considerable amount of time. However, for short-run print jobs in particular, it is important to be able to carry out as many print jobs as possible within a short period of time. As a consequence, frequent printing plate changes are of even greater significance. It is therefore important to reduce the overall time required for all printing plate changes as much as possible.

Figure 3:
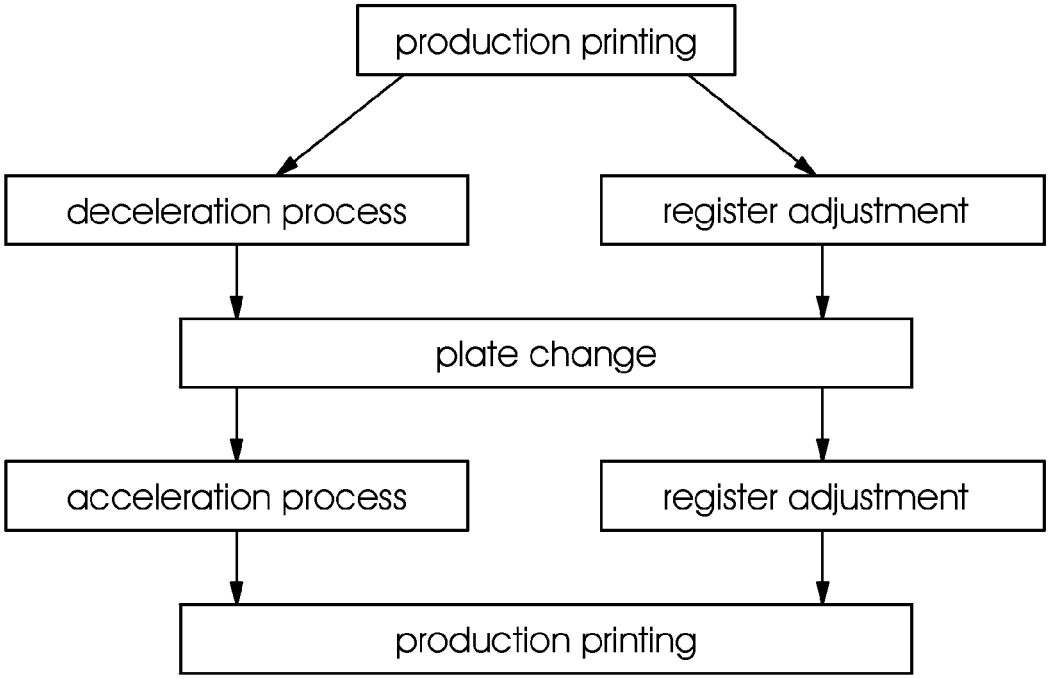
FIG. 3 is a flow diagram illustrating set-up processes for a plate change involving parallel register adjustment processes during speed change phases.

The method of the invention shown in FIG. 3 may reduce the time required for a plate change. After switching off the transport of printing substrates, the printing press 30, which was running at production speed, is decelerated. At the same time, the control unit 8 actuates the register adjustment drives 9 in the printing units 1, 2, 3, thus returning the plate cylinders 23 to the zero position. Subsequently, a plate change is carried out in the printing units 1, 2, 3. Once the plate change is completed, the control unit 8 reaccelerates the printing press 30 and simultaneously actuates the register adjustment drives 9 to accurately adjust the plate cylinders 23 for the new print job. As becomes apparent from FIG. 3, in the method of the invention the register adjustment processes on the register adjustment drives 9 do not require additional time because they are carried out in parallel with the periods of speed change of the printing press 30. This means a significant reduction of the time required for the entire plate changing process.

Figure 4:
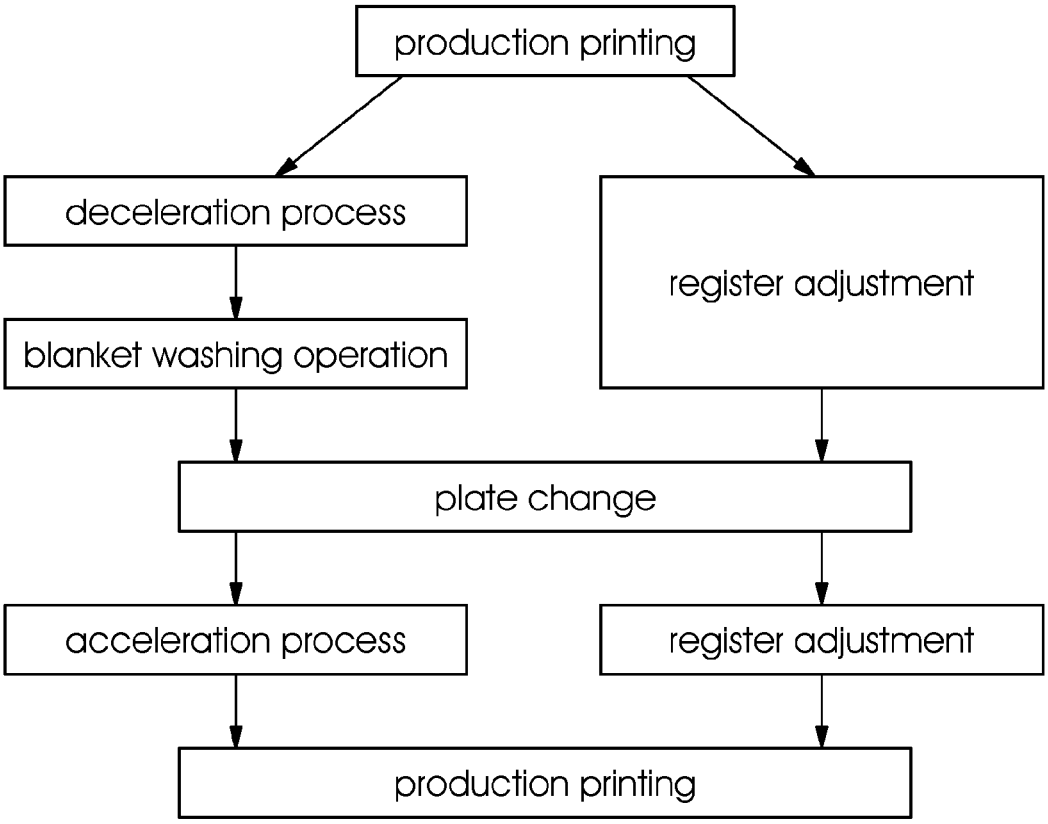
FIG. 4 is a flow diagram illustrating a method according to the invention for a plate change with parallel register adjustment processes during a blanket washing operation and an acceleration process after a plate change.

A further embodiment of the invention is shown in FIG. 4. In this embodiment, the plate change additionally involves an ink change, requiring at least the blanket on the blanket cylinder 22 to be washed. In this case, as a first step, the control unit 8 decelerates the printing press. Then the blanket is washed. During the blanket washing process, the main drive motor 5 of the printing press 30 causes the blanket cylinders 22 to rotate. While the washing processes continue and additionally even during the deceleration period, the register adjustment drives 9 are actuated to move the plate cylinders 23 into the zero position. It may even be sufficient to carry out the register adjustment processes only during the washing operation. This depends on the period of time required for the washing operation and for the deceleration and on the speed of the register adjustment drives 9. Then the blanket washing process may immediately be followed by the actual change of plates 6, 7. When the plate change is completed, the control unit 8 will re-accelerate the printing press 30. At the same time, the register adjustment drives 9 are actuated to carry out the register adjustments for the new print job while the printing press is being accelerated. Afterwards the control unit 8 reaccelerates the printing press 30 to production speed and the new print job may be processed.

As is apparent from FIGS. 3 and 4, in accordance with the present invention, the register adjustment processes do not require any additional time beyond the other set-up processes required for a plate change. The result is a further reduction of the time required for a plate change. In this way, the printing press 30 can be operated with significantly higher efficiency, in particular when short-run print jobs are being processed.

The invention claimed is:

1. A method for setting up printing presses, the method comprising the following steps:

providing cylinders, a drive for at least one of the cylinders, a register adjustment device for at least one of the cylinders and at least one control unit; and actuating the register adjustment device using the control unit during a set-up operation while the printing press is being decelerated and while a production run is switched off and the cylinders are rotating or while the printing press is being accelerated and while a production run is switched off and the cylinders are rotating.

2. The method according to claim 1, which further comprises:

providing printing units in the printing press; and acting on the same one of the cylinders in the same one of the printing units using the drive and the register adjustment device.

3. The method according to claim 1, which further comprises:

providing printing units in the printing press; and acting on different cylinders in the same one of the printing units using the drive and the register adjustment device.

4. The method according to claim 1, which further comprises:

providing a first printing unit in the printing press having a first one of the cylinders;

providing a second printing unit in the printing press having a second one of the cylinders;

acting on the first cylinder using the drive; and acting on the second cylinder using the register adjustment device.

5. The method according to claim 1, which further comprises accelerating the printing press after a change of a printing plate on a plate cylinder and simultaneously actuating the register adjustment device, using the control unit.

6. The method according to claim 1, which further comprises providing one of the cylinders as a rotating blanket cylinder, and actuating the register adjustment device using the control unit while the rotating blanket cylinder is being washed.

7. The method according to claim 1, which further comprises simultaneously adjusting circumferential, lateral and diagonal registers using the control unit.

8. The method according to claim 1, which further comprises actuating the register adjustment device using the control unit simultaneously with a speed change from a production speed to an idle speed or from an idle speed to a production speed.

9. The method according to claim 1, which further comprises actuating and moving the register adjustment device to a zero position using the control unit simultaneously with a deceleration from a production speed for a plate change.

10. A printing press, comprising:

cylinders;

a drive for at least one of said cylinders;

a register adjustment device for at least one of said cylinders; and at least one control unit configured to actuate said register adjustment device during a set-up operation while decelerating the printing press and while a production run is switched off and the cylinders are rotating or while accelerating the printing press and while a production run is switched off and the cylinders are rotating.

* * * * *